US006211475B1

(12) United States Patent
Ozaki

(10) Patent No.: US 6,211,475 B1
(45) Date of Patent: Apr. 3, 2001

(54) KEYBOARD WITH KEY LOCK FUNCTION

(75) Inventor: Akiyo Ozaki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/482,078

(22) Filed: Jan. 13, 2000

(30) Foreign Application Priority Data

Jan. 14, 1999 (JP) ..... 11-007397

(51) Int. Cl.[7] ..... H01H 9/20

(52) U.S. Cl. ..... 200/43.01; 200/50.33; 200/321; 200/5 A

(58) Field of Search ..... 200/5 A, 5 B, 200/5 C, 5 E, 43.01, 50.01, 50.32, 50.33, 50.36, 50.37, 318, 321, 322, 341, 344, 345; 400/472, 473, 490, 491, 491.2, 495, 495.1, 496; 341/22; 361/680

(56) References Cited

U.S. PATENT DOCUMENTS

| | | | | |
|---|---|---|---|---|
| 4,065,650 | * | 12/1977 | Lou | 200/5 R |
| 4,160,886 | * | 7/1979 | Wright et al. | 200/5 A |
| 5,481,264 | * | 1/1996 | Kim | 341/20 |
| 5,629,694 | * | 5/1997 | Simon et al. | 341/22 |
| 5,803,237 | * | 9/1998 | Gandre et al. | 200/43.01 |

FOREIGN PATENT DOCUMENTS

| | | | |
|---|---|---|---|
| 63-268024 | 11/1988 | (JP) | G06F/3/02 |
| 1-76630 | 5/1989 | (JP) | G06F/3/02 |

* cited by examiner

*Primary Examiner*—Michael Friedhofer
(74) *Attorney, Agent, or Firm*—Foley & Lardner

(57) ABSTRACT

A keyboard has a slidable key lock switch which is supported in a keyboard housing and not slidable for unintentional switching between a lock position and an unlock position. The keyboard also has a contact provided on a lead for sending signals from a keyboard circuit in the keyboard housing to an information processing device. The contact can selectively be opened and closed by a manually operable member of the key lock switch.

4 Claims, 2 Drawing Sheets

KEYBOARD WITH KEY LOCK FUNCTION

BACKGROUND OF THE INVENTION

1. Field of the Invention

The present invention relates to a keyboard with a key lock function, for supplying signals to an information processing device such as a personal computer through key button actions.

2. Description of the Prior Art

Some keyboards electrically connected to information processing devices have a key lock function for preventing the keyboard from supplying signals to the information processing device even when key buttons are undesirably pressed for some reason while the information processing device is being turned on and not attended by the operator. The key lock function is effective to prevent stored data in the information processing device from being eliminated or broken, for example, through unintentional key button actions.

Known keyboards with a key lock function are disclosed in Japanese laid-open utility model publication No.76630/1989 and Japanese laid-open patent publication No. 268024/1988 for example.

The keyboard disclosed in Japanese laid-open utility model publication 76630/1989 has a key lock switch mounted on the upper surface thereof, the key lock switch being pressable downwardly. When the key lock switch is pressed downwardly by the operator, the keyboard enters a lock mode.

The keyboard disclosed in Japanese laid-open patent publication No. 268024/1988 includes logic circuit 5 disposed below and connected to switching part 3 (key lock switch) and keyboard circuit 1 for entering signals. Insofar as the logic circuit is supplied with a lock mode signal from the key lock switch, the logic circuit does not deliver a signal to the central processing circuit 6 (an information processing device) even when a key button is pressed to supply a key signal.

With the keyboard disclosed in Japanese laid-open utility model publication No.76630/1989, since the key lock switch is a pressable switch mounted on the upper surface of the keyboard, when the key lock switch is inadvertently pressed, the keyboard changes from the lock mode to an unlock mode against the will of the operator.

Japanese laid-open patent publication No.268024/1988 is silent about the type and layout of the key lock switch in the switching part. Since the disclosed keyboard needs the logic circuit, the keyboard is complex in structure and susceptible to a higher failure rate, and tends to suffer a high manufacturing cost.

SUMMARY OF THE INVENTION

A principal object of the present invention is to provide a keyboard with a key lock function, which is highly reliable against unintentional switching from a lock mode to an unlock mode against the will of the operator.

Another object of the present invention is to provide a keyboard with a key lock function, which is relatively simple in structure, has a relatively low failure rate, and can be manufactured at a relatively low cost.

A keyboard with a key lock function according to the present invention includes a key lock switch which has a structure that is resistant to unintentional switching from a lock position to an unlock position, or means for preventing unintentional switching from a lock position to an unlock position.

The keyboard has a key lock switch which may comprise a slide switch that can slide selectively between the lock position and the unlock position.

The key lock switch can open and close at least one contact which may be provided on a corresponding one of signal lines for sending signals from a keyboard circuit to an information processing device.

The key lock switch has a manually operable member disposed on an upper surface of a keyboard housing and may directly be connected to the contact within the keyboard housing.

The above and other objects, features, and advantages of the present invention will become apparent from the following description with reference to the accompanying drawings which illustrate an example of the present invention.

DESCRIPTION OF THE PREFERRED EMBODIMENT

Figure 1:
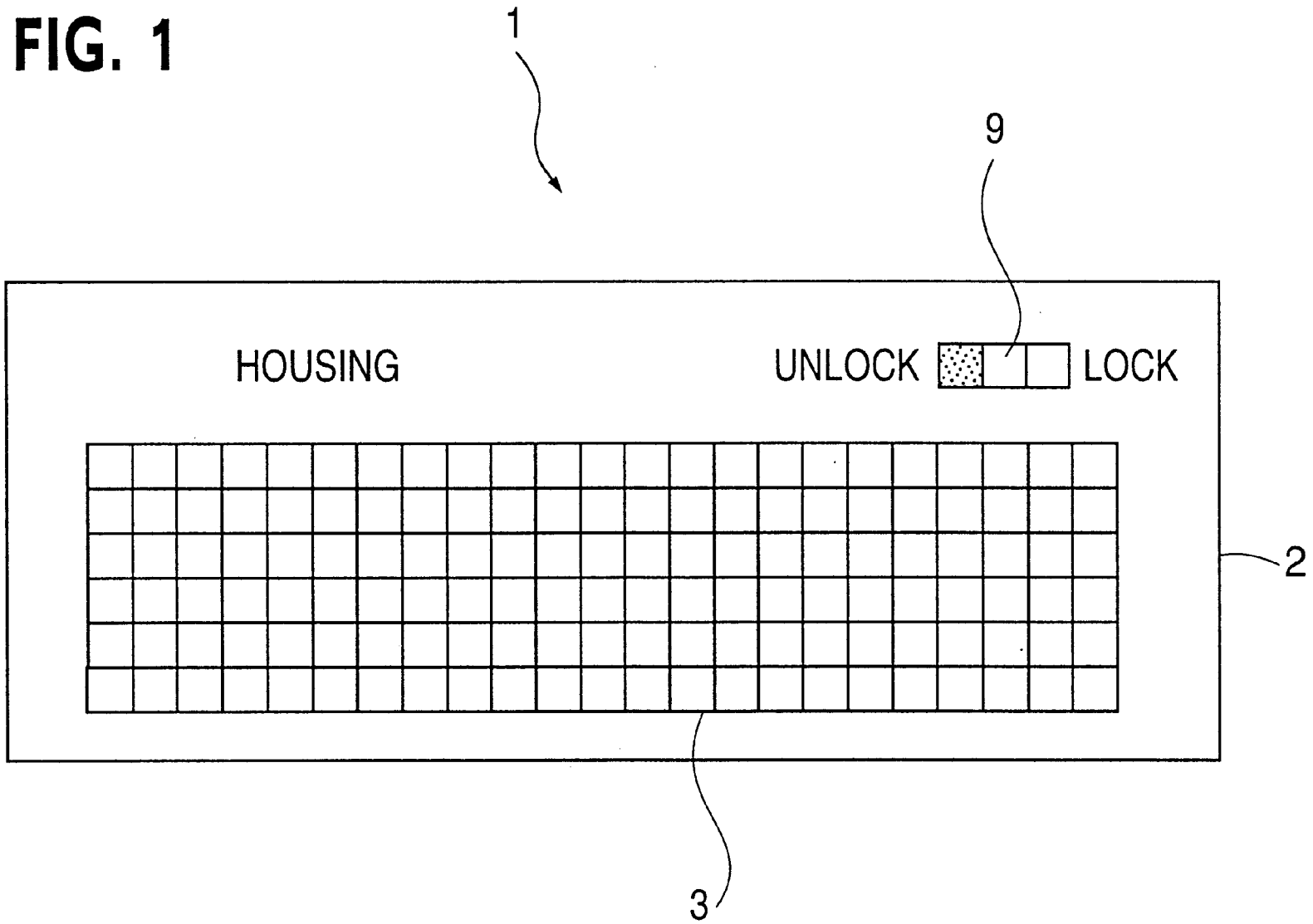
FIG. 1 is a plan view of a keyboard according to the present invention.

As shown in FIG. 1, keyboard 1 according to the present invention has housing 2, a plurality of key buttons 3 for supplying signals, supported in housing 2 and projecting from an upper surface of housing 2, and key lock switch 9 supported in housing 2 and projecting from the upper surface of housing 2. Key lock switch 9 comprises a slide switch which can horizontally slide selectively between a lock position (shown as a right-hand position) and an unlock position (shown as a left-hand position). Key lock switch 9 has a structure which is resistant to the sliding motion to the lock position (right-hand position) or the unlock position (left-hand position) unless a manually operable member of key lock switch 9 is intentionally operated.

Figure 2:
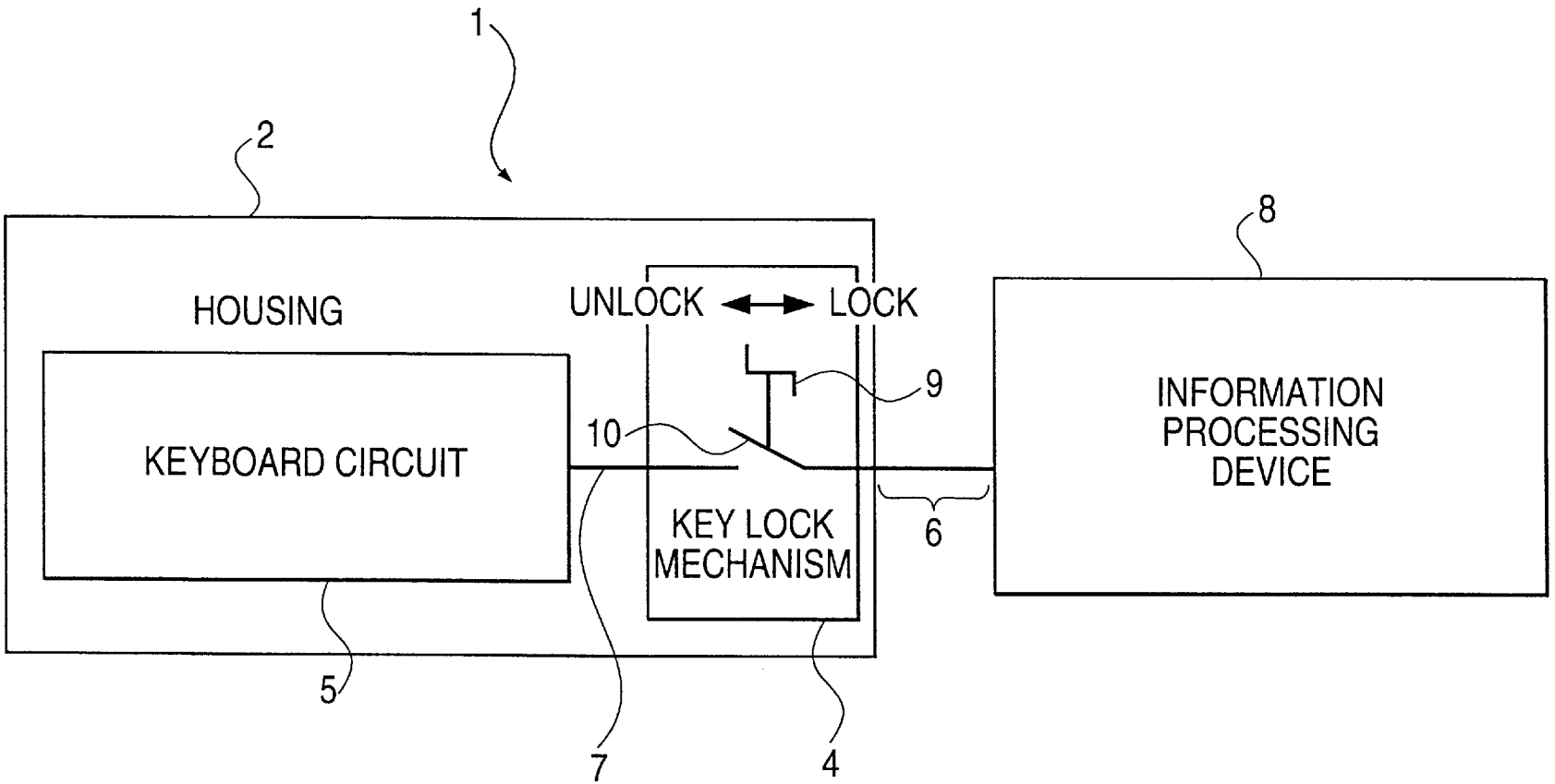
FIG. 2 is a view, partly in block form, showing connections of a key lock mechanism of the keyboard shown in FIG. 1.

As shown in FIG. 2, housing 2 accommodates therein keyboard circuit 5 which is connected to external information processing device 8 such as a personal computer or the like via keyboard cable 6 extending out of keyboard 1 via key lock mechanism 4 which includes lead 7 connected to keyboard circuit 5 and contact 10 connected to keyboard cable 6.

Key lock mechanism 4 comprises key lock switch 9 and contact 10 that is associated with lead 7. Key lock switch 9 is directly connected to contact 10, and can open the contact 10 out of contact with lead 7 for thereby disconnecting lead 7 and keyboard cable 6 from each other, and close contact 10 into contact with lead 7 for thereby connecting lead 7 and keyboard cable 6 to each other. If each of lead 7 and keyboard cable 6 has four cores, then contact 10 comprises four contact elements.

When key lock switch 9 is slid to the unlock position, contact 10 is closed, connecting lead 7 to keyboard cable 6. Keyboard 1 is now placed in an unlock mode, and keyboard circuit 5 is connected to information processing device 8 via lead 7, contact 10, and keyboard cable 6. When the operator of keyboard 1 presses one of key buttons 3, keyboard circuit 5 sends a signal corresponding to pressed key button 3 to information processing device 8.

When key lock switch 9 is slid to the lock position, contact 10 is opened, disconnecting lead 7 from keyboard cable 6. Keyboard 1 is now placed in a lock mode, and keyboard circuit 5 is disconnected from information processing device 8. Even when the operator presses one of key buttons 3, no signal is sent from keyboard circuit 5 to information processing device 8. Therefore, when the operator slides key lock switch 9 to the lock position at the time the operator leaves keyboard 1, keyboard 1 switches to the lock mode. Even if one of key buttons 3 is undesirably pressed for some reason, no signal is sent from keyboard circuit 5 to the information processing device 8.

The slidable key lock switch 9 is disposed on the upper surface of housing 2 of keyboard 1. Unlike a pressable switch, key lock switch 9 is of such a structure that it will not be inadvertently turned on or off. Accordingly, key board 1 is prevented from switching from the lock mode to the unlock mode against the will of the operator.

Consequently, as long as keyboard 1 is in the lock mode, data stored in information processing device 8 is prevented from being undesirably eliminated or broken while keyboard 1 is not being attended by the operator. Since no lock circuit is added to keyboard 1, keyboard 1 is relatively simple in structure, has a relatively low failure rate, and can be manufactured at a relatively low cost.

While a preferred embodiment of the present invention has been described using specific terms, such description is for illustrative purposes only, and it is to be understood that changes and variations may be made without departing from the spirit or scope of the following claims.

What is claimed is:

1. A keyboard comprising:

a housing;

a plurality of key buttons supported in said housing for sending signals to an information processing device; and a key lock switch supported in said housing that prevents signals from being sent to the information processing device when any of said key buttons are pressed while the information processing device is turned on;

said key lock switch having a structure that is resistant to unintentional switching from a lock position to an unlock position, or means for preventing unintentional switching from a lock position to an unlock position.

2. A keyboard according to claim 1, wherein said key lock switch comprises a slide switch selectively slidable between the lock position and the unlock position.

3. A keyboard according to claim 1, further comprising:

a contact disposed in said housing and selectively openable and closable by said key lock switch; and a signal line for sending signals to the information processing device from a keyboard circuit disposed in said housing;

said contact being provided on a corresponding signal line.

4. A keyboard according to claim 3, wherein said key lock switch has a manually operable member disposed on an upper surface of said housing and directly connected to said contact within said housing.

* * * * *